US006271502B1

(12) United States Patent
Lee

(10) Patent No.: US 6,271,502 B1
(45) Date of Patent: Aug. 7, 2001

(54) QUICK-DISCONNECT ARRANGEMENT FOR OVEN DOOR

(76) Inventor: Wen-Ching Lee, No.214, 3 Rd Floor, Fu-Hsing North Road, Taipei City (TW)

( * ) Notice: Subject to any disclaimer, the term of this patent is extended or adjusted under 35 U.S.C. 154(b) by 0 days.

(21) Appl. No.: 09/507,221

(22) Filed: Feb. 18, 2000

(51) Int. Cl.[7] ..... F24C 15/04
(52) U.S. Cl. ..... 219/391; 126/194; 16/261
(58) Field of Search ..... 219/385, 386, 219/391; 126/190, 194; 16/261, 262, 268; 49/388, 389

(56) References Cited

U.S. PATENT DOCUMENTS 4,099,511 * 7/1978 McIntire et al. ..... 126/190
4,258,632 * 3/1981 LaPointe ..... 49/389
4,754,121 * 6/1988 Fujino et al. ..... 219/386

* cited by examiner

*Primary Examiner*—Joseph Pelham
(74) *Attorney, Agent, or Firm*—Pro Techtor International Services

(57) ABSTRACT

A quick-disconnect arrangement for an oven door mainly includes two pivotal pins provided at two lateral sides of the oven door and two insertion holes correspondingly provided on two walls of the oven between which the oven door is mounted, such that the oven door is pivotally connected to and between the two walls of the oven through engagement of the pivotal pins with the insertion holes. At least one of the two insertion holes defines a narrow long slot, so that the pivotal pin engaged therewith is movable therein. And, a maximum linear distance between the two insertion holes is slightly larger than a sum of the overall width of the oven door and the full length of one pivotal pin. Therefore, the oven door may be easily and quickly disconnected from the oven by turning the door open and lifting one side of the door adjacent to the narrow long slot to disengage the pivotal pin at that side from the narrow long slot and then removing the door from the electric oven.

3 Claims, 6 Drawing Sheets

QUICK-DISCONNECT ARRANGEMENT FOR OVEN DOOR

BACKGROUND OF THE INVENTION

The present invention relates to an oven door connection structure, and more particularly to a quick-disconnect arrangement for an oven door to enable easy and quick disconnection of the oven door from the oven to facilitate cleaning of the door and the interior of the oven.

Most of the currently available electric ovens have a door that is pivotally connected to the oven to turn between an opened and a closed position but could not be freely disconnected from the oven. On the other hand, an inner surface of the door and the interior of the oven tend to be smeared with spattered grease from heated food after the electric oven has been used for a long time. The smeared door and interior of the oven would adversely affect the thermal efficiency of the electric oven and it is therefore necessary to disconnect the door from the oven to facilitate cleaning of the door and the interior of the oven.

Please refer to FIG. 1 that is a partially exploded perspective of an electric oven 1 showing a conventional disconnection arrangement for a door 2 of the oven 1, and FIG. 2 that is a fragmentary sectional view of the conventional oven door disconnection arrangement of FIG. 1. The door 2 of the electric oven 1 has an inner frame 21 screwed to a backside of the door 2. The conventional oven door disconnection arrangement includes two insertion holes 11 symmetrically provided at two walls of the oven 1 between which the door 2 is mounted, a long bar 22 transversely extended across the inner frame 21 with two ends of the long bar 22 projecting from the inner frame 21 to engage into the two insertion holes 11 on the oven 1, a pull handle 23 extended from a middle point of the long bar 22 toward the oven 1 and projected from the inner frame 21, a spring 24 put around the long bar 22 to one side of the pull handle 23, and a guide slot 25 provided on the inner frame 21 close to the pull handle 23 and extended in parallel with the long bar 22, so that the pull handle 23 could be moved along the guide slot 25 toward the spring 24. With the arrangement, the pull handle 23 could be moved along the guide slot 25 toward the spring 24 when the door 2 has been pivotally turned to the opened position, so that the long bar 22 is brought to move along with the pull handle 23 until an end of the long bar 22 opposite to the spring 24 disengages from the corresponding insertion hole 11. At this point, the door 2 and the inner frame 21 may be disconnected and removed from the oven 1. The above-described conventional oven door disconnection arrangement has complicate structure and is difficult to assemble and therefore increases the cost for manufacturing the electric oven 1.

It is therefore tried by the inventor to develop a quick-disconnect arrangement for an oven door to eliminate the drawbacks existing in the conventional oven door disconnection arrangement.

SUMMARY OF THE INVENTION

A primary object of the present invention is to provide a quick-disconnect arrangement for an oven door that involves simple structure and could be easily handled to quickly disconnect an oven door from the oven to facilitate cleaning of the door and an interior of the oven.

To achieve the above and other objects, the oven door quick-disconnect arrangement according to the present invention mainly includes two pivotal pins provided at two lateral sides of the oven door and two insertion holes correspondingly provided on two walls of the oven between which the oven door is mounted, such that the oven door is pivotally connected to and between the two walls of the oven through engagement of the pivotal pins with the insertion holes. At least one of the two insertion holes defines a vertically extended narrow long slot, so that the pivotal pin engaged therewith is movable therein. And, a maximum linear distance between the two insertion holes is slightly larger than a sum of an overall width of the oven door and a full length of one pivotal pin. Therefore, the oven door may be easily and quickly disconnected from the oven by turning the door open and lifting one side of the door adjacent to the narrow long slot to disengage the pivotal pin at that side from the narrow long slot and then disconnecting and removing the door from the electric oven.

The quick-disconnect arrangement for the oven door may also be applied to a top cover of the electric oven. In this case, the insertion hole in the form of a narrow long slot is a horizontally extended slot.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
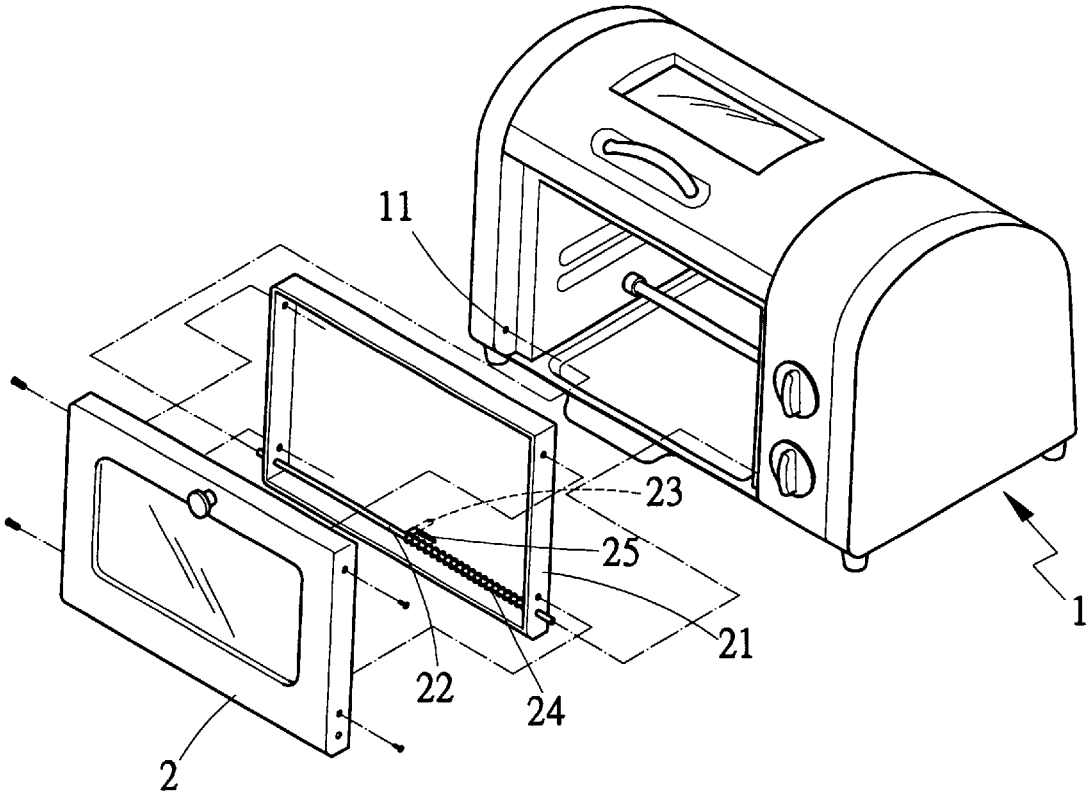
(PRIOR ART) Fig.1
FIG. 1 is a partially exploded perspective of an electric oven to show a conventional door disconnection arrangement for the oven.
Figure 2:
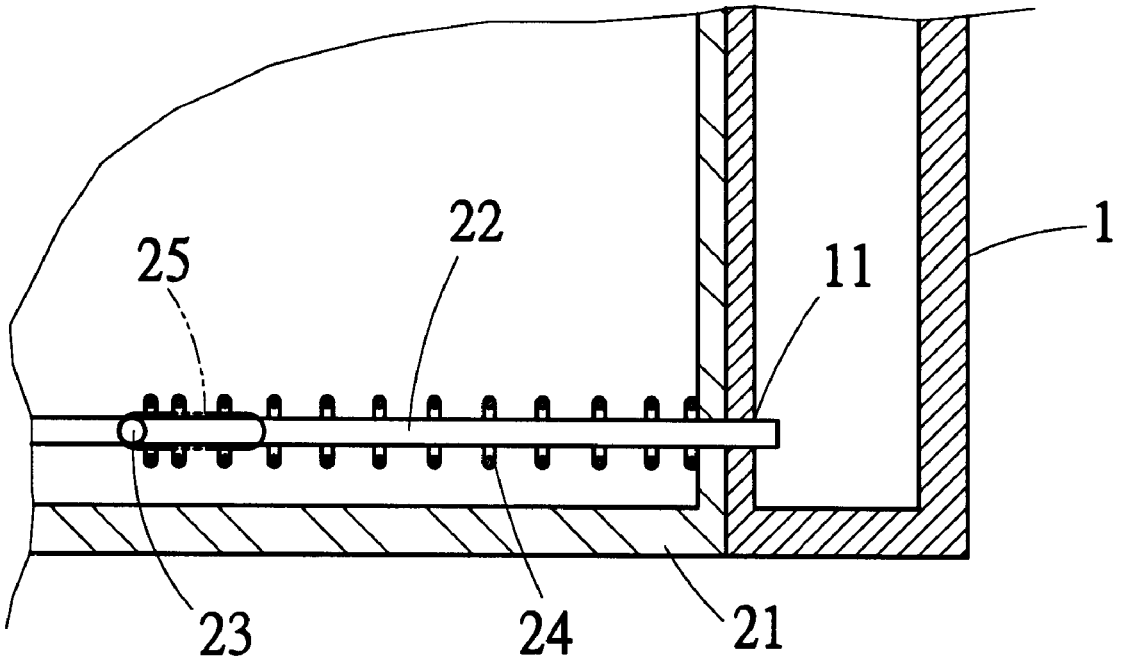
(PRIOR ART) Fig.2
FIG. 2 is a fragmentary sectional view of the oven door disconnection arrangement of FIG. 1.
Figure 3:
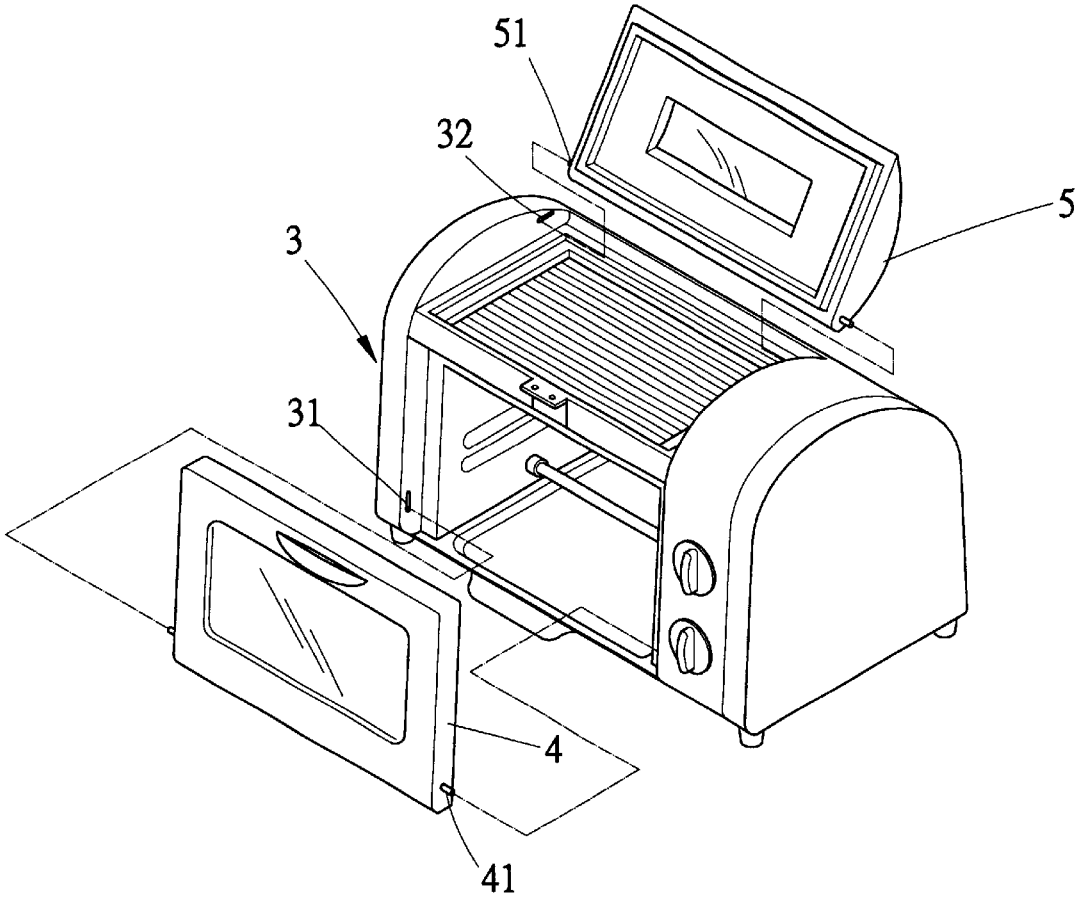
FIG. 3 is a partially exploded perspective of an electric oven showing the quick-disconnect arrangement for oven door according to a first embodiment of the present invention.
Figure 4:
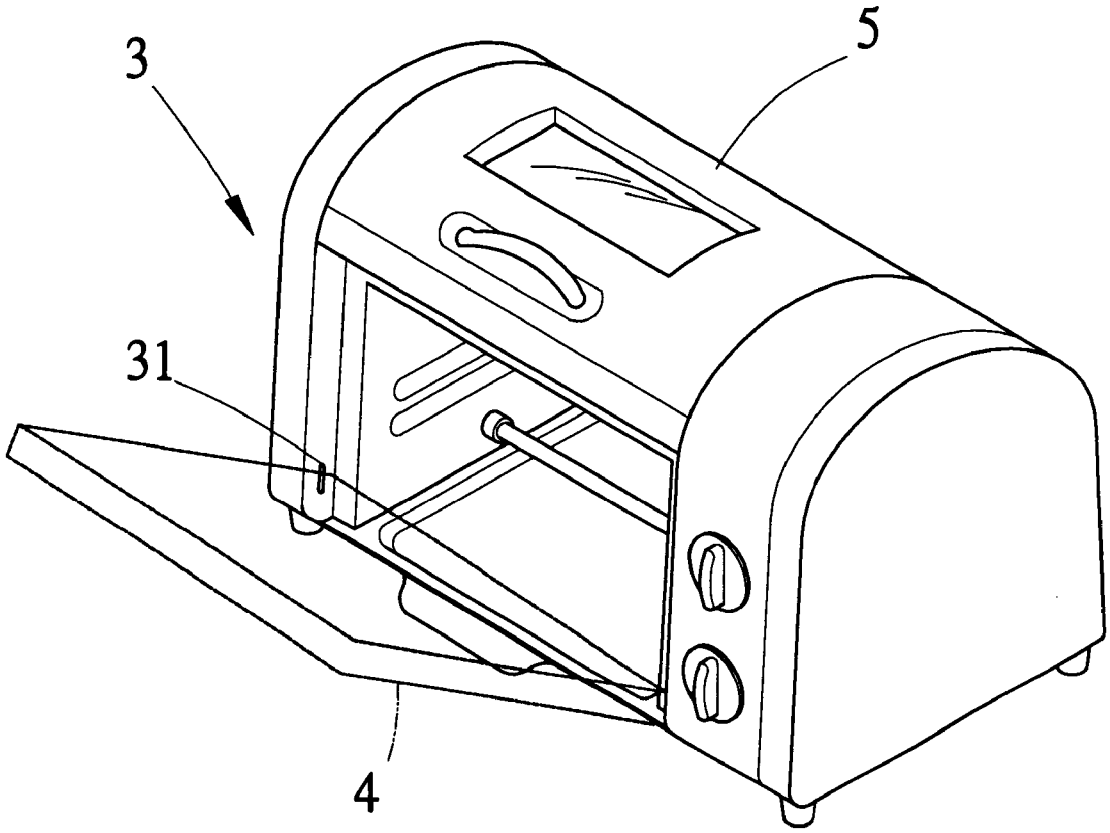
FIG. 4 is an assembled perspective of the electric oven of FIG. 3 with the oven door in an opened position to show an insertion slot included in the quick-disconnect arrangement of the present invention.

Please refer to FIG. 3 that is a partially exploded perspective view of an electric oven 3 and FIG. 4 that is an assembled perspective view of the oven 3 with a front door thereof in an opened position. As can be seen from FIG. 3, the electric oven 3 includes a front door 4 and a top cover 5. The front door 4 is pivotally connected to a front of the electric oven 3 between two side walls thereof through engagement of two first pivotal pins 41 projected from two lower outer ends of the door 4 with two first insertion holes 31 symmetrically provided on the two side walls of the oven 3 corresponding to the first pivotal pins 41. Similarly, the top cover 5 is pivotally connected to a top of the electric oven 3 between two side walls thereof through engagement of two second pivotal pins 51 projected from two rear outer ends of the cover 5 with two second insertion holes 32 provided on the two side walls of the oven 3 corresponding to the second pivotal pins 51. When the front door 4 and the top cover 5 are connected to the oven 3 through the engagement of the first and the second pivotal pins 41, 51 with the first and the second insertion holes 31, 32, respectively, the front door 4 and the top cover 5 may be pivotally turned about the pivotal pins 41, 51 between an opened and a closed position. It is to be noted that at least one of the two first insertion holes 31 is a vertically extended narrow long slot, such that one of the first pivotal pins 41 of the front door 4 corresponding to the vertical narrow long slot 31 is allowed to move vertically in the long slot 31. A maximum linear distance between the two first insertion holes 31 is slightly larger than a sum of an overall width of the front door 4 and a full length of one first pivotal pin 41. Similarly, at least one of the two second insertion holes 32 is a horizontally extended narrow long slot, such that one of the second pivotal pins 51 of the top cover 5 corresponding to the horizontal narrow long slot 32 is allowed to move horizontally in the long slot 32. And, a maximum linear distance between the two second insertion holes 32 is slightly larger than a sum of an overall width of the top cover 5 and a full length of one second pivotal pin 51.

A detailed description of the manner of quickly disconnecting the front door 4 from the electric oven 3 will follow now.

Figure 5:
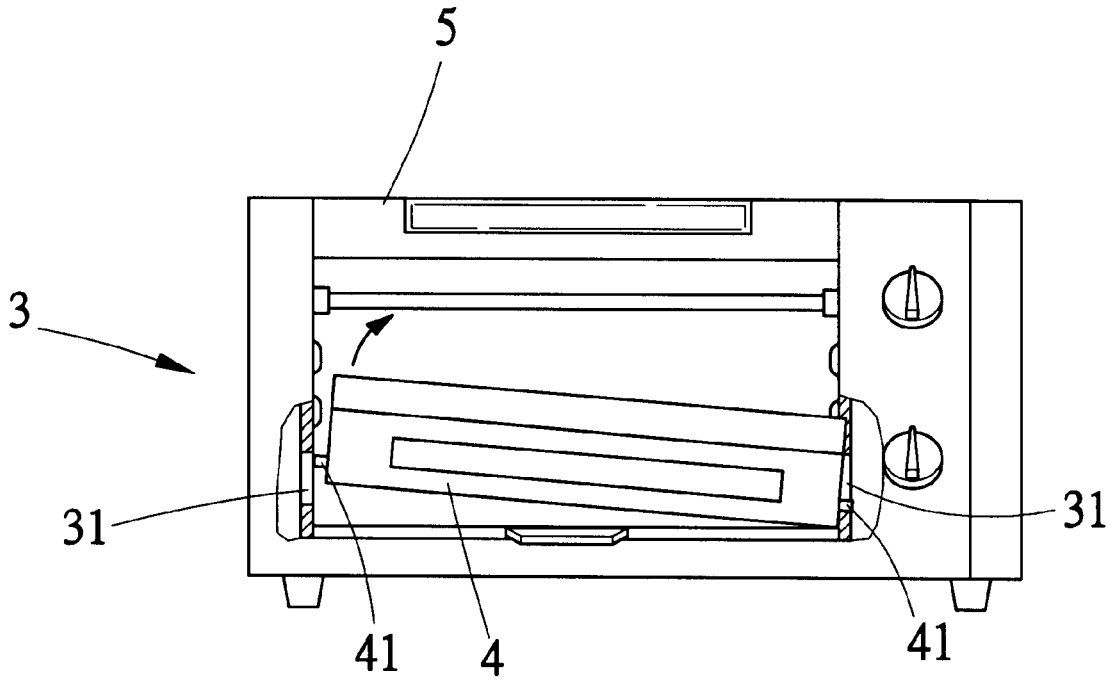
FIG. 5 schematically shows the manner of quickly disconnecting the door from the electric oven of FIG. 3.

Please refer to FIG. 5 that is a partially sectional front view of the electric oven 3 with the front door 4 in a fully opened position. To disconnect the opened front door 4 from the two side walls of the electric oven 3, first lift one side of the front door 4 that is adjacent to the vertically extended first insertion hole 31, so that the front door 4 is inclined between the two side walls of the oven 3. Since the maximum linear distance between the two first insertion holes 31 is slightly larger than the overall length of the front door 4 and the length of one first pivotal pin 41, it would be very easy to disengage the first pivotal pin 41 at the lifted side of the inclined front door 4 from the vertical first insertion hole 31 and accordingly easily disconnect and remove the front door 4 from the electric oven 3.

Since the manner of quickly disconnecting the top cover 5 from the two side walls of the electric oven 3 is the same as that for disconnecting the front door 4 from the electric oven 3, it is not repeatedly described herein.

Figure 6:
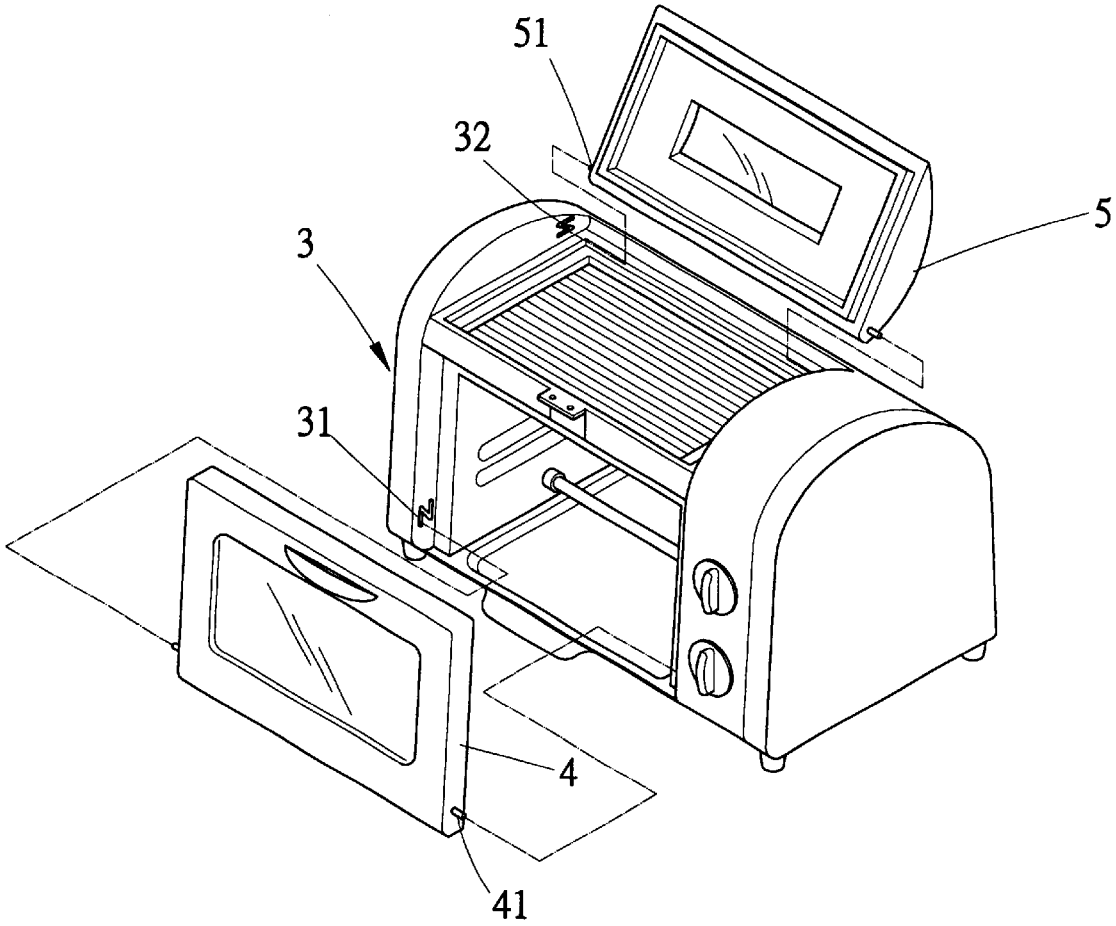
FIG. 6 is another partially exploded perspective of an electric oven showing the quick-disconnect arrangement for oven door according to a second embodiment of the present invention.

It is to be noted that the first and the second insertion holes 31, 32 are not necessarily a narrow long slot as shown in FIGS. 3, 4 and 5. Insertion holes of other suitable shapes are also acceptable so long as they provide the same effect as that of the first and the second insertion holes 31, 32. According to a second embodiment, the first and the second insertion holes 31 and 32 provided on the electric oven 3 are N-shaped slots as shown in FIG. 6. Such N-shaped insertion holes 31, 32 effectively prevent the oven door 4 and the top cover 5 from undesirably separating from the oven 3 when they are in the opened position.

The following are some advantages of the quick-disconnect arrangement for oven door according to the present invention:

1. Either the front door 4 or the top cover 5 may be easily dismounted from the electric oven 3 to facilitate cleaning of the front door, the top cover and the interior of the oven 3.
2. The oven door quick-disconnect arrangement is simple in its structure and therefore enables reduced manufacturing cost of the electric oven 3.

What is claimed is:

1. A quick-disconnect arrangement for a door on an electric oven comprising:

two pivotal pins projected from two lateral sides of said door and two insertion holes provided on two walls of said electric oven between which said door is mounted, said door being pivotally connected between said two walls of said oven through engagement of said two pivotal pins with said two insertion holes so that said door is pivotal about said pivotal pins between an opened position and a closed position relative to said oven; wherein at least one of said two insertion holes defines a narrow long slot, such that one of said two pivotal pins adjacent to said narrow long slot is movable in said narrow long slot, a maximum linear distance between said two insertion holes being slightly larger than a sum of an overall width of said door and a full length of one of said pivotal pins, said narrow long slot being a vertically extended zigzag slot; whereby said door may be easily and quickly disconnected from said oven by turning said door to said opened position and lifting one side of said door adjacent to said narrow long slot to disengage said pivotal pin at the lifted side of said oven door from said narrow long slot.

2. A quick-disconnect arrangement for a door on an electric oven as claimed in claim 1 wherein:

said door is a front door of said electric oven.

3. A quick-disconnect arrangement for a door on an electric oven as claimed in claim 1 wherein:

said door is a top cover of said electric oven.

* * * * *